US009440809B2

(12) United States Patent
Kuwata et al.

(10) Patent No.: US 9,440,809 B2
(45) Date of Patent: Sep. 13, 2016

(54) SHEET STACKING APPARATUS AND IMAGE FORMING APPARATUS

(71) Applicant: CANON KABUSHIKI KAISHA, Tokyo (JP)

(72) Inventors: Takashi Kuwata, Suntou-gun (JP); Takehito Osada, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/955,391

(22) Filed: Dec. 1, 2015

(65) Prior Publication Data

US 2016/0159589 A1 Jun. 9, 2016

(30) Foreign Application Priority Data

Dec. 4, 2014 (JP) ..... 2014-246304

(51) Int. Cl.

| | |
|---|---|
| ***B65H 1/26*** | (2006.01) |
| ***G03G 15/00*** | (2006.01) |
| ***G03G 21/00*** | (2006.01) |
| ***B65H 1/22*** | (2006.01) |
| ***B65H 1/04*** | (2006.01) |

(52) U.S. Cl.
CPC *B65H 1/22* (2013.01); *B65H 1/04* (2013.01); *B65H 1/266* (2013.01)

(58) Field of Classification Search
CPC ..... G03G 15/00; G03G 21/00; B65H 1/00; B65H 1/04; B65H 1/22; B65H 1/26; B65H 1/266
See application file for complete search history.

(56) References Cited

U.S. PATENT DOCUMENTS

| | | | | |
|---|---|---|---|---|
| 5,700,006 | A | 12/1997 | Sekiya et al. | |
| 5,765,826 | A | 6/1998 | Isoda et al. | |
| 6,527,267 | B1 | 3/2003 | Kuwata et al. | |
| 6,643,480 | B2 | 11/2003 | Kuwata et al. | |
| 8,807,559 | B2 | 8/2014 | Osada et al. | |
| 2008/0111295 | A1* | 5/2008 | Tanaka | B41J 13/103 271/164 |
| 2013/0221600 | A1* | 8/2013 | Kotaka | B65H 1/00 271/9.08 |

FOREIGN PATENT DOCUMENTS

| | | | | |
|---|---|---|---|---|
| JP | 62259931 | A * | 11/1987 | B65H 1/26 |
| JP | 2005330054 | A * | 12/2005 | B65H 1/26 |
| JP | 2007-145551 | A | 6/2007 | |
| JP | 2008254874 | A * | 10/2008 | B65H 1/26 |

OTHER PUBLICATIONS

Copending, U.S. Appl. No. 14/972,367 to Takehito Osada, filed Dec. 17, 2015, unpublished.

* cited by examiner

*Primary Examiner* — Nguyen Ha
(74) *Attorney, Agent, or Firm* — Fitzpatrick, Cella, Harper & Scinto

(57) ABSTRACT

A sheet stacking apparatus includes a main body, a first storage unit configured to be drawn out of/inserted into the main body and storing a sheet, and a second storage unit configured to be drawn out of/inserted into the main body, provided above the first storage unit, and storing a sheet. The first storage unit includes a guide portion, and the second storage unit includes an abutment portion guided by the guide portion when the second storage unit is drawn out of the main body in a state in which the first storage unit is being precedingly drawn out of the main body.

17 Claims, 14 Drawing Sheets

SHEET STACKING APPARATUS AND IMAGE FORMING APPARATUS

BACKGROUND OF THE INVENTION

1. Field of the Invention

The present invention relates to a sheet stacking apparatus on which a sheet is stacked and to an image forming apparatus including the same.

2. Description of the Related Art

In general, an image forming apparatus such as a printer is provided with a sheet feed cassette storing a sheet at a lower part of a main body such that the sheet feed cassette can be drawn out of/inserted into the main body. In connection with such image forming apparatus, Japanese Patent Application Laid-open No. 2007-145551 for example proposes an image forming apparatus in which a bottom surface of a sheet storage cassette composes a bottom surface of a main body and the sheet storage cassette is provided with a projection such as a rib at the bottom surface thereof in order to reduce an interference between the sheet storage cassette and an installation surface where the image forming apparatus is installed.

Still further, there is known an image forming apparatus provided with a plurality of stages of sheet feed cassettes in order to store various types of sheets and a large volume of sheets.

Lately, it is required to downsize the image forming apparatus in a height direction from aspects of operability and storability. Still further, the image forming apparatus including a plurality of stages of sheet feed cassettes is required to improve designability and to cut cost by cutting a number of parts by providing no intermediate cover between these plurality of sheet feed cassettes and by reducing gaps between the sheet feed cassettes.

However, the following problems occur if the sheet feed cassettes are provided in close proximity with each other. FIGS. 14A and 14B illustrate one example of such case. As shown in FIG. 14A, the image forming apparatus 300 includes sheet feed cassettes 301 and 302 provided at two stages of upper and lower stages. In terms of an exterior of the sheet feed cassettes, a boundary between the upper and lower sheet feed cassettes is formed by an exterior cover 311 composing the sheet feed cassette 301 and an exterior cover 312 composing the sheet feed cassette 302. In a state in which the sheet feed cassettes 301 and 302 are stored in the image forming apparatus 300, a gap between the exterior covers 311 and 312 is a distance H.

Suppose here that the upper sheet storage cassette 301 fully loaded with sheets is drawn out in a state in which the lower sheet storage cassette 302 is being precedingly drawn out as shown in FIG. 14B for example. The sheet feed cassette 301 hangs downward because a cassette base and a cassette rail deform due to weight of the sheets SS and the sheet feed cassette 301. In a case when a vertical distance of the sheet feed cassette 301 hanging downward exceeds the distance H between the exterior covers 311 and 312, there is a case when a lower corner edge 311*a* of the exterior cover 311 interferes with an upper corner edge 312*a* of the exterior cover 312, thus disabling the sheet feed cassette 301 to be fully opened. Thereby, there is a case when an enough space necessary for replenishing sheets SS into the sheet feed cassette 301 cannot be assured or the lower sheet storage cassette 302 cannot be closed. Noted that it is unable to prevent the upper sheet storage cassette 301 from interfering with the lower sheet storage cassette 302 even if a projection is provided on a lower surface of the lower sheet storage cassette 302 like a sheet storage cassette disclosed in Japanese Patent Application Laid-open No. 2007-145551.

SUMMARY OF THE INVENTION

A sheet stacking apparatus of the present disclosure includes a main body, a first storage unit configured to be drawn out of/inserted into the main body and storing a sheet, and a second storage unit configured to be drawn out of/inserted into the main body, provided above the first storage unit, and storing a sheet. The first storage unit includes a guide portion and the second storage unit includes an abutment portion guided by the guide portion of the first storage unit when the second storage unit is drawn out of the main body in a state in which the first storage unit is being precedingly drawn out of the main body.

Further features of the present invention will become apparent from the following description of exemplary embodiments with reference to the attached drawings. The accompanying drawings, which are incorporated in and constitute apart of the specification, illustrate exemplary embodiments, features, and aspects of the invention and, together with the description, serve to explain the principles of the invention.

DESCRIPTION OF THE EMBODIMENTS

First Embodiment

Figure 1:
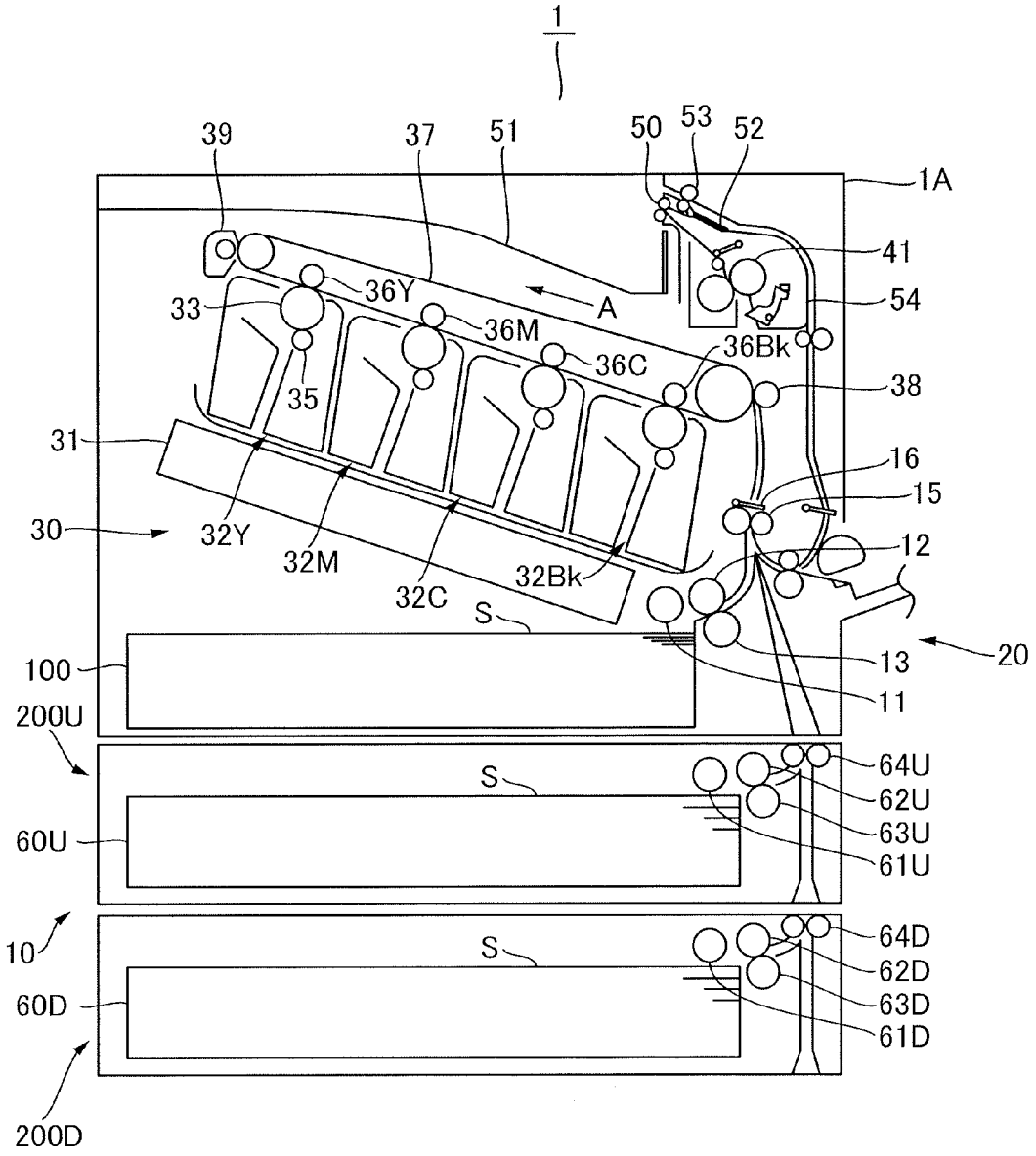
FIG. 1 is a schematic diagram illustrating an overall configuration of a printer of a first embodiment.

A printer of a first embodiment will be described below at first. The printer 1 (image forming apparatus) of the first embodiment is an electro-photographic laser beam printer forming a four-color toner image. As shown in FIG. 1, the printer 1 includes a sheet stacking portion 10 in which a sheet is stacked, a sheet feed portion 20 feeding the sheet stacked on the sheet stacking portion 10, and an image forming portion 30 forming an image on the sheet fed from the sheet feed portion 20.

In response to an instruction given to the printer 1 to form an image, the printer 1 starts an image forming process by the image forming portion 30 based on image information inputted from an external computer or the like connected with the printer 1. The image forming portion 30 includes a scanner unit 31 and four process cartridges 32Y, 32M, 32C, and 32Bk forming the four color images of Yellow (Y), magenta (M), Cyan (C), and black (Bk). It is noted that the four process cartridges 32Y, 32M, 32C, and 32Bk have a same configuration except that the colors of images to be formed are different, so that only an image forming process of the process cartridge 32Y will be described, and an explanation of the other process cartridges 32M, 32C, and 32Bk will be omitted below.

The scanner unit 31 irradiates a laser beam to a photosensitive drum 33 of the process cartridge 32Y based on the inputted image information. At this time, the photosensitive drum 33 is charged by a charging roller not shown in advance, and an electrostatic latent image is formed on the photosensitive drum 33 in response to the irradiation of the laser beam. Then, the electrostatic latent image is developed by a developing roller 35 and a toner image of yellow (Y) is formed on the photosensitive drum 33.

In the same manner, magenta (M), cyan (C), and black (Bk) toner images are formed also on photosensitive drums of the process cartridges 32M, 32C, and 32Bk. The respective color toner images formed on the respective photosensitive drums are transferred onto an intermediate transfer belt 37 by primary transfer rollers 36Y, 36M, 36C, and 36Bk and are conveyed to a secondary transfer roller 38 by the intermediate transfer belt 37 rotating in a direction of an arrow A in FIG. 1. It is noted that the image forming processes of the respective colors are carried out in synchronism with superimposition of an upstream toner image primarily transferred onto the intermediate transfer belt 37.

In parallel with the abovementioned image forming process, the sheet S stacked in the sheet stacking portion 10 (sheet stacking apparatus) is fed by a sheet feed portion 20. The sheet stacking portion 10 includes a cassette 100 provided such that the cassette 100 can be drawn out of/inserted into a main body 1A of the printer 1 as well as upper and lower units 200U and 200D provided as options. The sheet feed portion 20 includes a pickup roller 11, a feed roller 12, and a retard roller 13. The sheet S stacked on the cassette 100 is fed by the pickup roller 11. The sheet S fed by the pickup roller 11 is separated one by one by the feed roller 12 and the retard roller 13 and is conveyed to the registration roller 15.

A sheet of a size different from that in the cassette 100 is stacked in the upper unit 200U for example and is conveyed to the registration roller 15 by a pickup roller 61U, a feed roller 62U, a retard roller 63U, and a conveying roller pair 64U. In the same manner, the lower unit 200D also includes a pickup roller 61D, a feed roller 62D, a retard roller 63D, and a conveying roller pair 64D. The sheet S conforming to selected sheet size is fed out of the cassette 100 and the upper and lower units 200U and 200D.

The full-color toner image on the intermediate transfer belt 37 is transferred by a secondary transfer bias applied to the secondary transfer roller 38 onto a first surface of the sheet S whose skew has been corrected by the registration roller 15 and conveyed to a secondary transfer nip portion at a predetermined conveying timing. It is noted that a top sensor 16 detecting a position of the sheet S or jamming is provided downstream in a sheet conveying direction of the registration roller 15. Still further, a cleaning portion 39 is provided to collect residual toner left on the intermediate transfer belt 37.

The sheet S on which the toner image has been transferred is subjected to predetermined heat and pressure in a fixing apparatus 41 such that the toner on the sheet melts and is fixed to the sheet. The sheet S which has passed through the fixing apparatus 41 is discharged to a discharge tray 51 by a discharge roller pair 50.

In a case of forming images on both surfaces of the sheet S, the sheet S is guided to a reversing roller pair 53 by a switching member 52. In response to a passage of a rear end of the sheet S through the switching member 52, the reversing roller pair 53 rotate reversely and the switching member 52 is driven such that the sheet S is guided to a duplex conveying path 54. The sheet S conveyed to the duplex conveying path 54 is conveyed to the registration roller 15 and the toner image is formed on the second surface by the secondary transfer roller 38. Then, the toner image is fixed by the fixing apparatus 41, and the sheet S on which the images are formed on the first and second surfaces thereof is discharged to the discharge tray 51 by the discharge roller pair 50.

Next, the upper and lower units 200U and 200D will be described in detail. The upper and lower units 200U and 200D are constructed in the same manner. Therefore, in the following description, reference numerals affixed by 'U' denote components of the upper unit 200U and reference numerals affixed by 'D' denote components of the lower unit 200D. Hence, basically only the upper unit 200U will be described below and an explanation of the lower unit 200D will be omitted.

Figure 2:
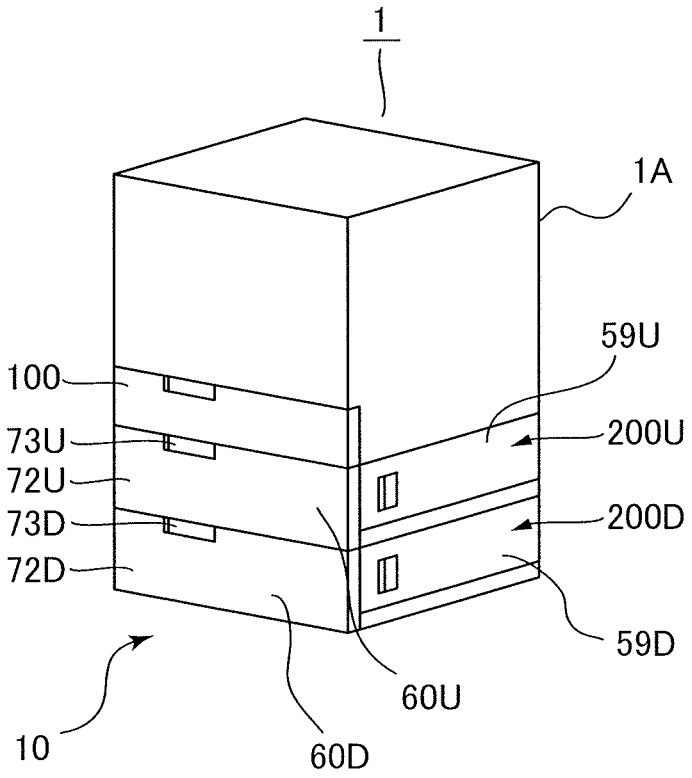
FIG. 2 is a perspective view schematically illustrating the printer.
Figure 3:
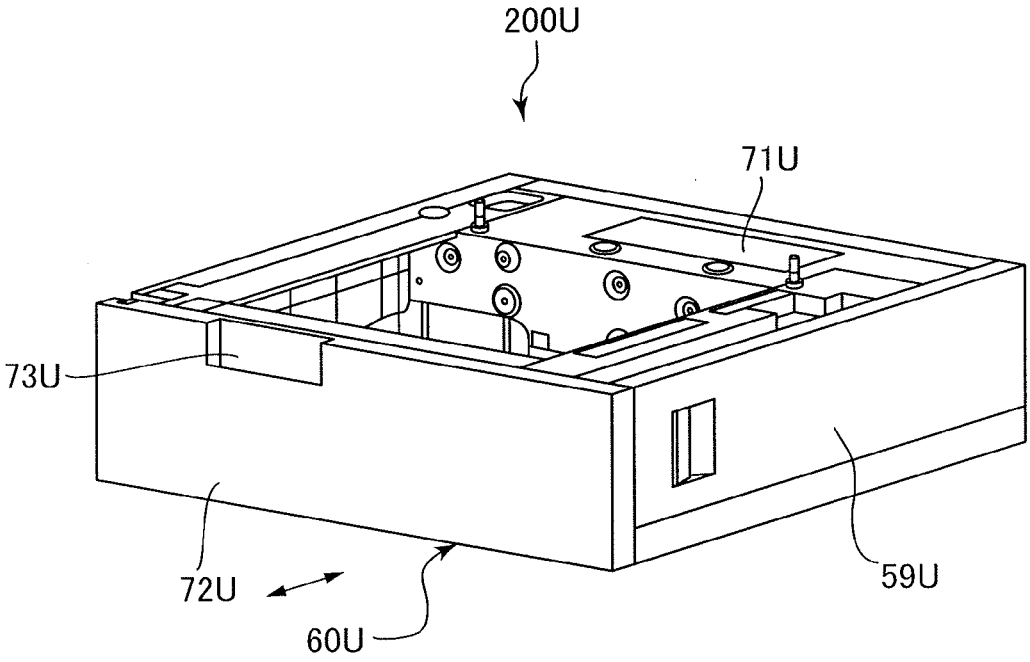
FIG. 3 is a perspective view illustrating an upper unit of a sheet stacking portion.

The upper unit 200U includes a housing 59U connected with the main body 1A of the printer 1 and a storage unit 60U (second storage unit) provided drawably out of/insertably into the housing 59U. As shown in FIGS. 2 and 3, the storage unit 60U includes a storage portion 71U into which the sheet is stored and an exterior cover 72U provided at an end of the storage portion 71U in a direction in which the storage unit 60U is drawn out (referred to as a 'drawing direction' hereinafter).

Figures 4A, 4B:
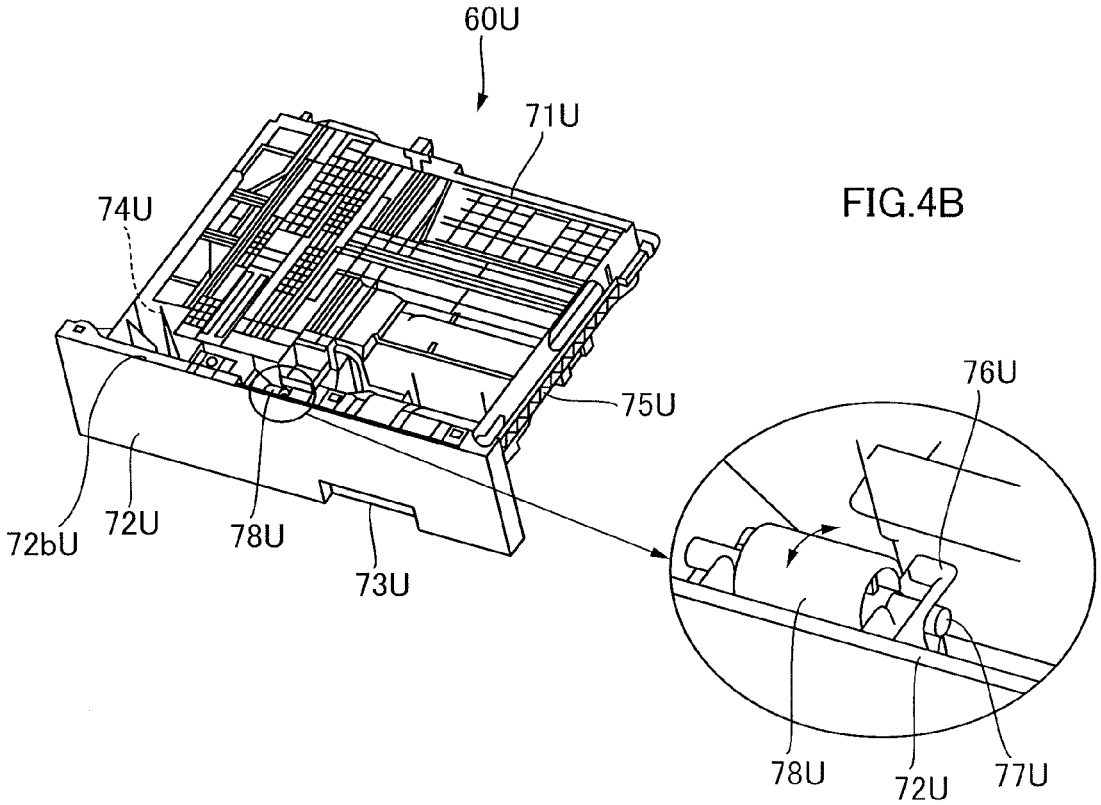
FIG. 4A is perspective view illustrating a bottom of a storage unit.
FIG. 4B is an enlarged perspective view illustrating a roller.

As shown in FIG. 4A illustrating a bottom surface of the storage unit 60U, guide portions 75U and 74U guided by guide rails not shown provided on the housing 59U are provided on both right and left side surfaces of the storage portion 71U. Formed on a front side in the drawing direction of the exterior cover 72U is a gripper 73U held by a user in drawing/inserting the storage unit 60U out of/into the main body 1A. It is noted that the gripper 73U is not always necessary, and the user can draw/insert the storage unit 60U by holding an end portion of the exterior cover 72U instead of holding the gripper 73U.

Formed at a center part of the storage unit 60U at a lower part (lower surface) of the exterior cover 72U in a direction orthogonal to the drawing direction is a rib 76U which rotatably supports a rotational shaft 77U of a roller 78U (attachment portion, rotator). The roller 78U is provided so as to project downward from a lower surface 72*b*U of the exterior cover 72U.

Figure 5:
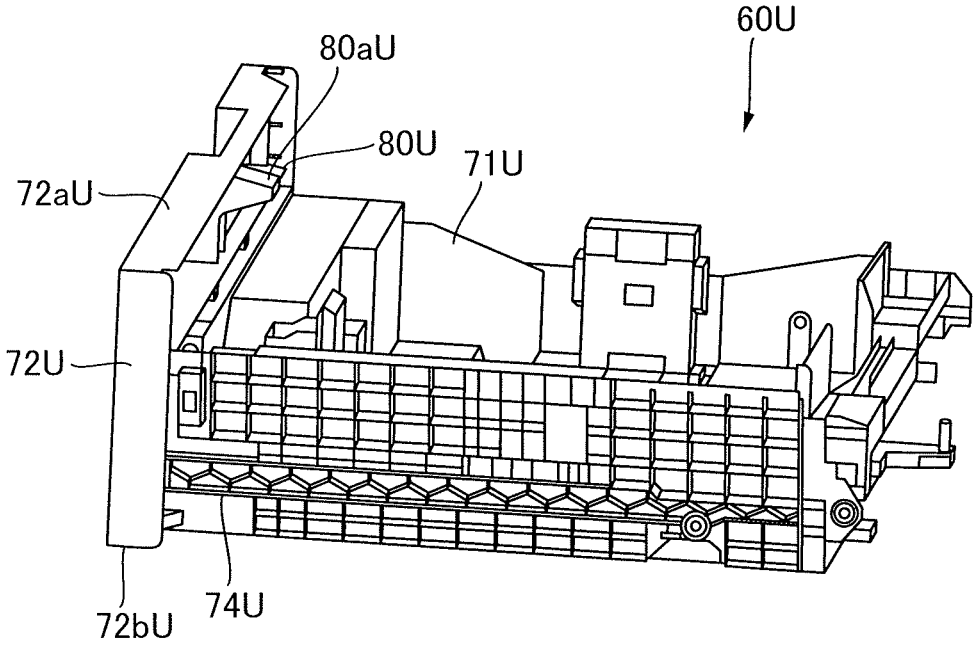
FIG. 5 is a perspective view illustrating a side of the storage unit.

As shown in FIG. 5, formed at a center part of the storage unit 60U at an upper part (upper surface) of the exterior cover 72U in the direction orthogonal to the drawing direction is a guide portion 80U projecting in a direction in which the storage unit 60U is inserted (referred to as a 'insertion direction' hereinafter). The guide portion 80U includes a guide surface 80*a*U (inclined surface) inclined upward in the drawing direction of the storage unit 60U and being continuous to an upper surface 72*a*U of the exterior cover 72U.

Figure 6A:
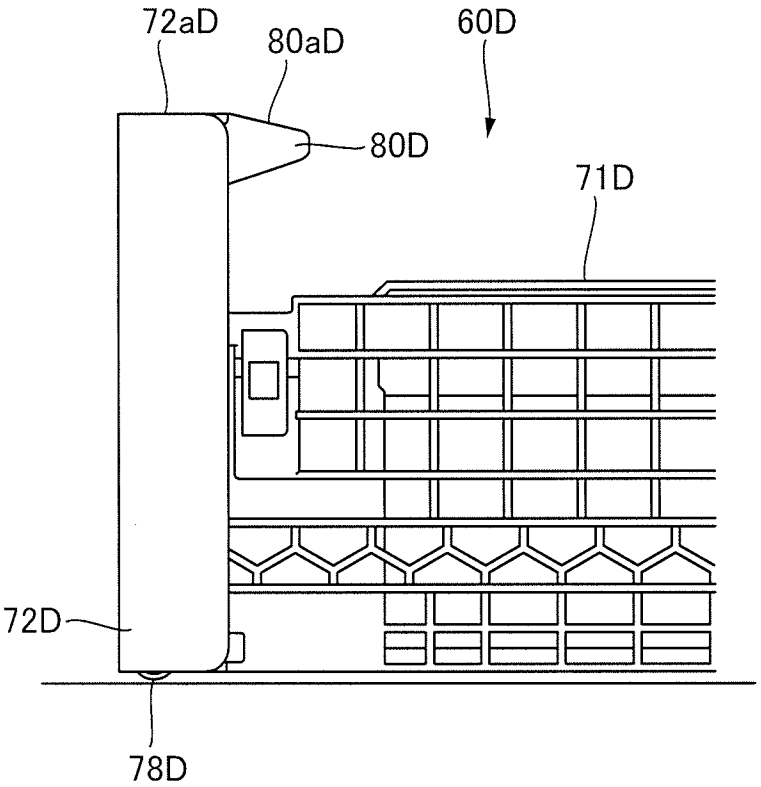
FIG. 6A is a side view of the storage unit.
Figure 6B:
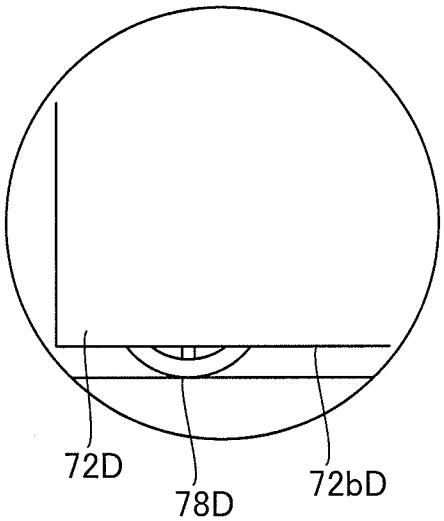
FIG. 6B is an enlarged side view of a roller.

Here, because the storage unit 60D (first storage unit) of the lower unit 200D is constructed in the same manner with the storage unit 60U, the storage unit 60U is naturally provided with a roller 78D (rotator) and a guide portion 80D as shown in FIG. 6A. While a lower surface of the lower unit 200D is configured to be a grounding surface of the printer 1, a roller 78D is provided so as to project downward from a lower surface 72*b*U of the exterior cover 72D and the storage unit 60D can be drawn out smoothly because the roller 78D rotates.

Figure 7:
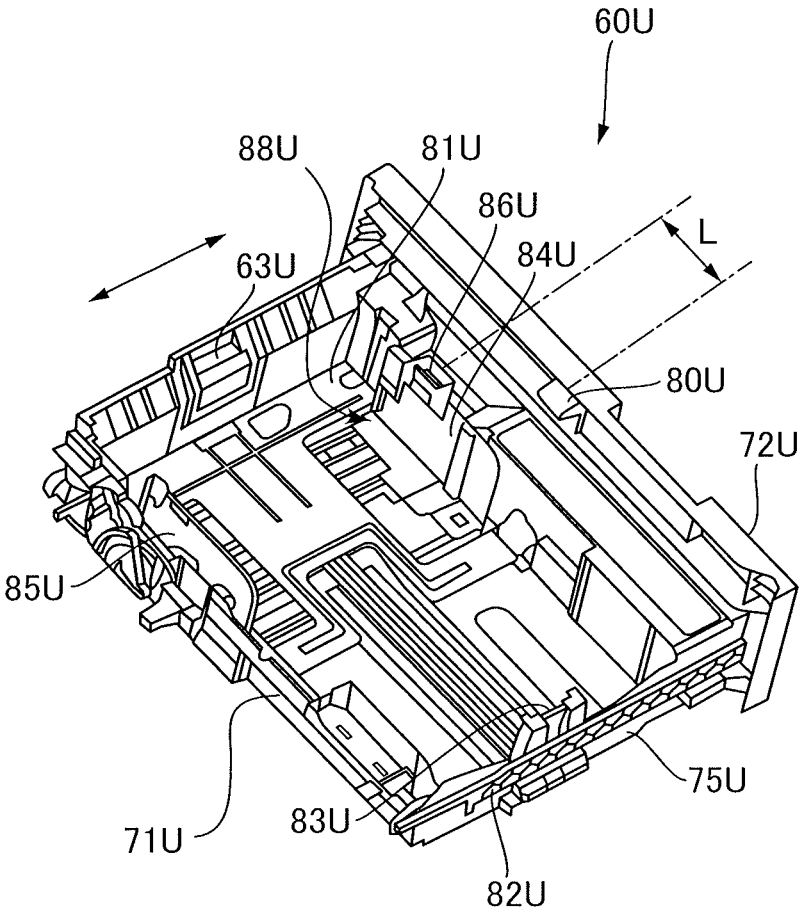
FIG. 7 is a perspective view illustrating an inside of the storage unit.

Next, an internal structure of the storage unit 60U will be described with reference to FIG. 7. It is noted that the sheet is conveyed in a direction orthogonal to the drawing direction, in the embodiment shown in FIG. 7 (referred to as a 'sheet conveying direction' hereinafter). As shown in FIG. 7, the storage unit 60U includes an intermediate plate 81U configured to be able to lift up the sheet stacked thereon and a rear edge restricting member 83U restricting a rear end, i.e., an upstream end in the sheet conveying direction, of the sheet on the intermediate plate 81U. The rear edge restricting member 83U is configured to be able to move upstream or downstream in the sheet conveying direction in response to a manipulation of a lever 82U made by the user and is positioned at a position corresponding to size of the sheet stacked on the intermediate plate 81U.

The storage unit 60U also includes a front and rear side restricting plates 84U and 85U, i.e., positioning portions, positioning the sheet stacked on the intermediate plate 81U by restricting positions in a width direction (indicated by an arrow in FIG. 7) orthogonal to the sheet conveying direction of the sheet. The front and rear side restricting plates 84U and 85U are linked so as to move widthwise in opposite directions from each other by a lack and pinion mechanism not shown. The front side restricting plate 84U also includes a lock mechanism 88U by which the move of the front side restricting plate 84U is restricted by engaging a groove formed in the storage portion 71U with a hook formed on the front side restricting plate 84U. The lock mechanism 88U is unlocked and the front side restricting plate 84U becomes slidingly movable (manipulable) as the user manipulates a manipulation lever 86U (manipulation portion).

The manipulation lever 86U is disposed at a position shifted from the guide portion 80U by a distance L in the direction orthogonal to the drawing direction. That is, the manipulation lever 86U is disposed at the position differing from the guide portion 80U in the direction orthogonal to the drawing direction. This arrangement makes it possible to improve the operability because the guide portion 80U is out of a way when the user manipulates the manipulation lever 86U to position the front and rear side restricting plates 84U and 85U.

Figure 8A:
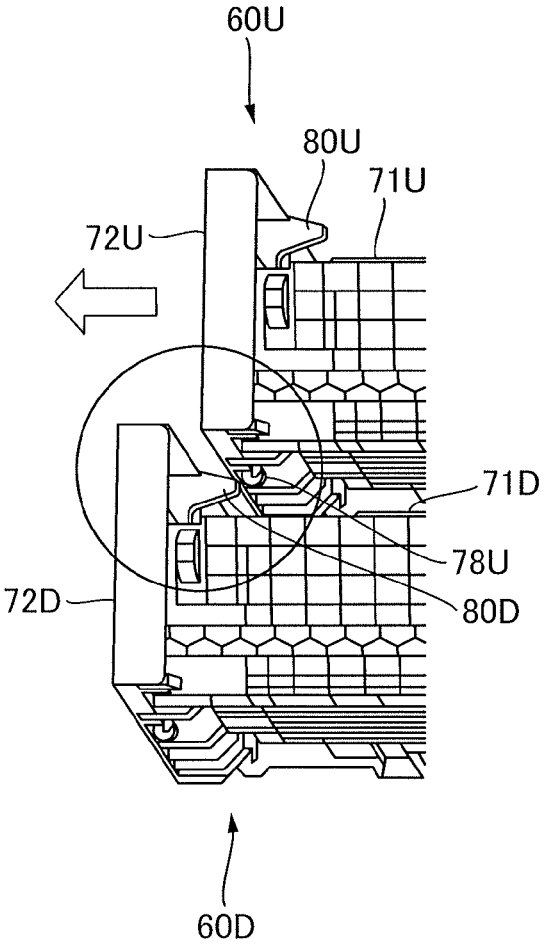
FIG. 8A is a perspective view illustrating sides of the upper and lower storage unit.
Figure 8B:
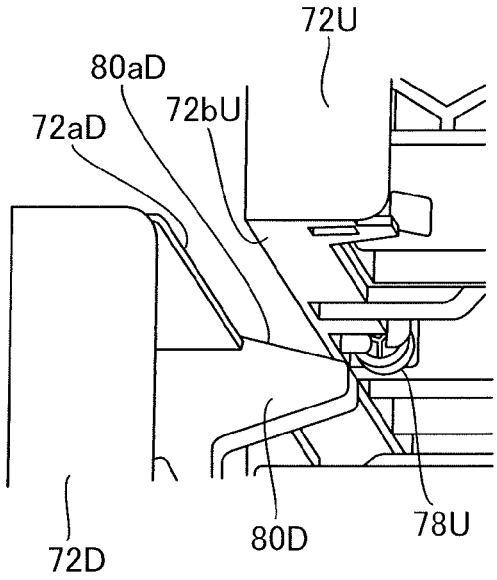
FIG. 8B is an enlarged perspective view illustrating a positional relationship between the roller and a guide portion.

Next, an operation in drawing out the storage units 60U and 60D will be described with reference to FIGS. 8A and 8B. FIGS. 8A and 8B show a state in which the user tries to draw the storage unit 60U out of the housing 59U in a state in which the storage unit 60D is being drawn out of the housing 59D precedingly by a maximum stroke. At this time, the storage unit 60U is fully loaded with sheets and hangs downward because the guide portions 74U and 75U and the storage portion 71U deform elastically by weight of the sheets and the storage unit 60U. Note that there is a possibility that the storage unit 60U hangs downward if an amount of sheets heavier than a predetermined weight is stacked, even if the storage unit 60U is not fully loaded with the sheets.

Figure 9:
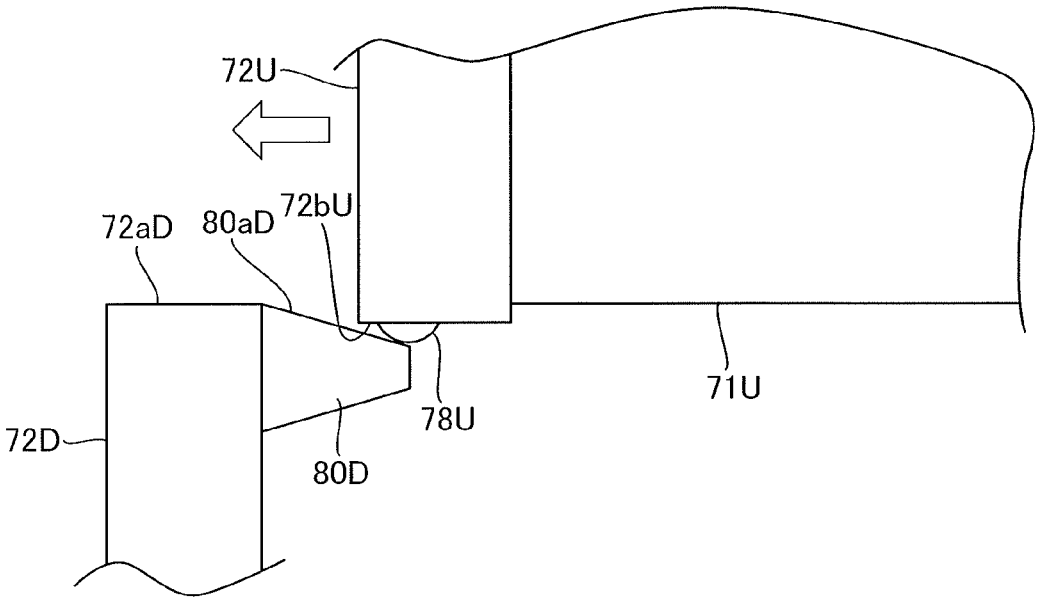
FIG. 9 is a side view illustrating a condition in which the roller is in contact with the guide portion.

If the storage unit 60U is drawn out further, a roller 78U provided in the upper storage unit 60U abuts against the guide surface 80*a*D of the guide portion 80D provided in the lower storage unit 60D as shown in FIG. 9. Then, if the user draws out the storage unit 60U further, the roller 78U of the upper storage unit 60U rolls on the guide surface 80*a*D and is guided in the drawing direction. At this time, because the guide surface 80*a*D is formed to incline upward in the drawing direction, the upper storage unit 60U which has been hanged down by weight of the sheets and own weight is lifted up. Still further, because the guide surface 80*a*D and the upper surface 72*a*D of the exterior cover 72D are smoothly continuously formed, it is possible to stably and steadily draw the storage unit 60U to the maximum stroke.

This arrangement makes it possible to fully assure a space for stacking sheets into the storage unit 60U and to improve sheet stackability. Still further, while the storage unit 60U is drawn out in the state in which the storage unit 60D is being drawn out precedingly in the abovementioned description, the same advantageous effect is brought about also an operation inverse to the abovementioned state. The similar effect is brought about also in inserting the storage units 60U and 60D. Therefore, it is possible to improve the manipulability of the storage units 60U and 60D. In particular, according to the present embodiment, the storage units 60U and 60D do not interfere with each other and the manipulability is improved even if the storage units 60U and 60D are provided in close proximity with each other to downsize and to improve an appearance of the printer 1.

It is noted that an inclination angle of the guide surface and an amount of the projection of the roller 78U with respect to the lower surface 72*b*U of the exterior cover 72 are appropriately set such that the exterior covers 72U and 72D do not interfere with each other in drawing or inserting the storage units 60U and 60D.

Figure 10:
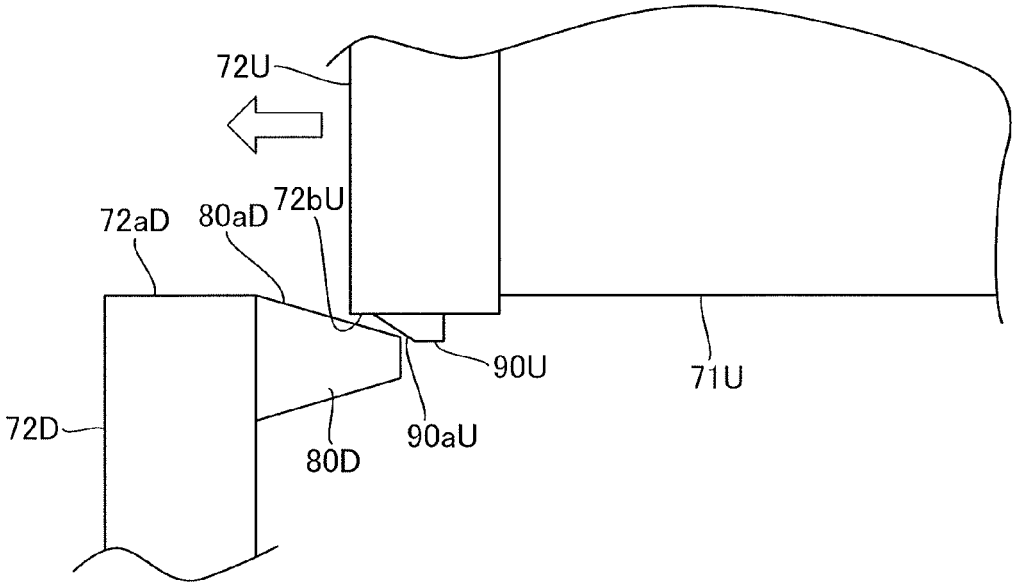
FIG. 10 is a side view illustrating a rib according to another embodiment.

Still further, it is also possible to provide a guide portion 80U projecting downward from the lower surface 72*b*U of the exterior cover 72U as shown in FIG. 10 instead of the roller 78U. More preferably, it is possible to smoothly draw out the storage unit 60U by reducing friction between the rib 90U and the guide portion 80D by providing a tapered surface 90*a*U inclined upward in the drawing direction on the rib 90U.

Still further, while the sheet stacking apparatus has been described based on the upper and lower units 200U and 200D provided as an option in the present embodiment, a roller may be provided also on a bottom surface of the cassette 100. That is, the sheet stacking apparatus may be configured by either two among the cassette 100, the upper unit 200U, and the lower unit 200D composing the sheet stacking portion 10.

Still further, the upper unit 200U or the lower unit 200D itself removably provided as an option in the image forming apparatus such as the printer 1 may be arranged as the sheet stacking apparatus. In this case, even if the plurality of upper or lower units 200U or 200D is provided in a vertical direction, these sheet stacking apparatuses will not interfere with each other when they are drawn out, so that the similar advantageous effect with the present embodiment can be obtained.

Still further, the sheet stacking apparatus may be configured, not by what is removably provided in the main body 1A as an option, but by a plurality of storage units such as the cassette 100 for example in the image forming apparatus. If the storage unit is configured such that the storage unit can be drawn out of/inserted into the main body, a main body for the cassette 100, i.e., the storage unit, is the main body 1A of the printer 1. Still further, in the case of the upper unit 200U provided as the option, the housing 59U becomes a main body.

Second Embodiment

Figure 11:
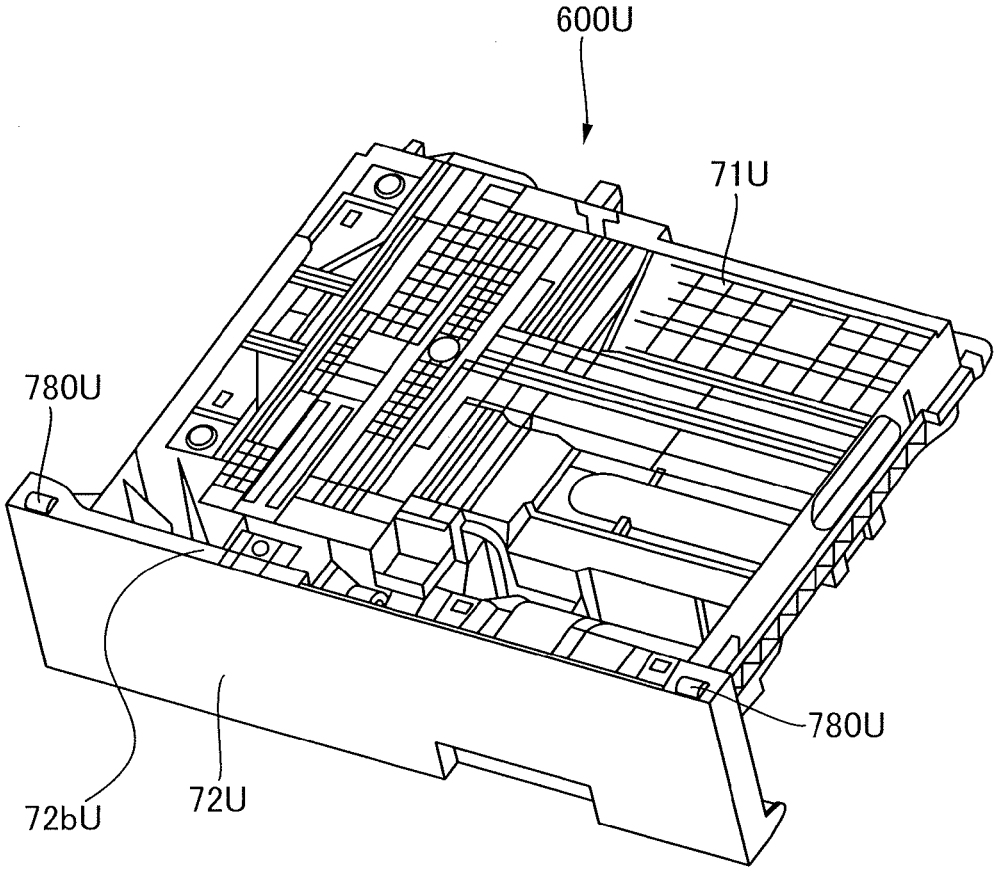
FIG. 11 is a perspective view illustrating a bottom of a storage unit of a second embodiment.

Next, a second embodiment will be described with reference to FIGS. 11 through 13. It is noted that in the present embodiment, same components with those of the first embodiment will be denoted by the same reference numerals and their overlapped explanation will be omitted here. As shown in FIG. 11, the upper storage unit 600U includes an exterior cover 72U and two rollers 780U and 780U (first and second abutment portions) rotatably supported at both end portions of the lower surface 72*b*U of the exterior cover 72U. That is, the rollers 780U and 780U are provided to be distant from each other in the direction orthogonal to the drawing direction.

Figure 12:
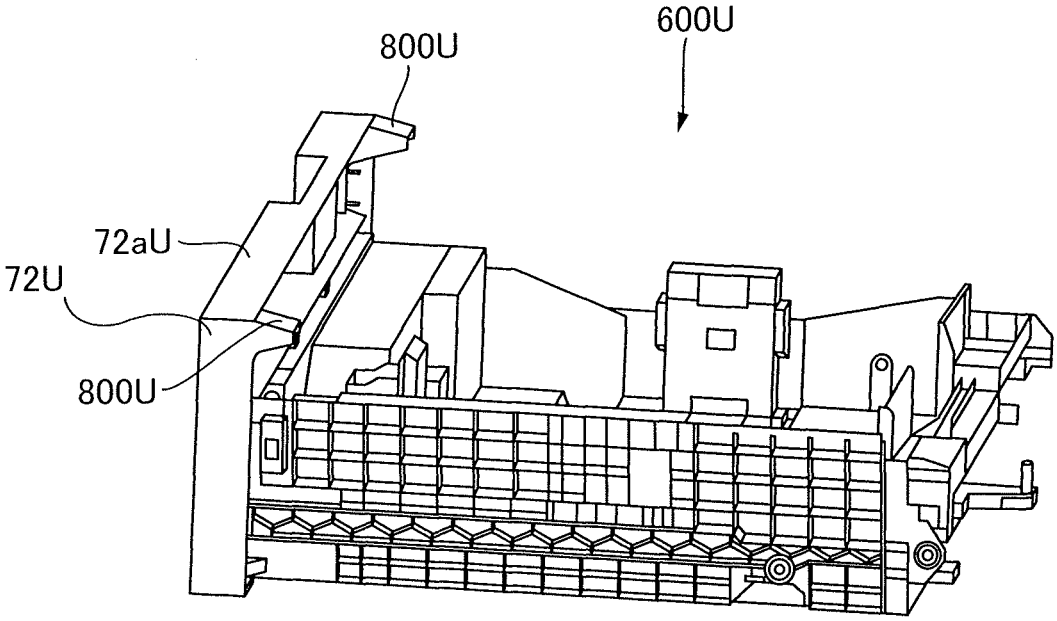
FIG. 12 is a perspective view illustrating a side of the storage unit.
Figure 13A:
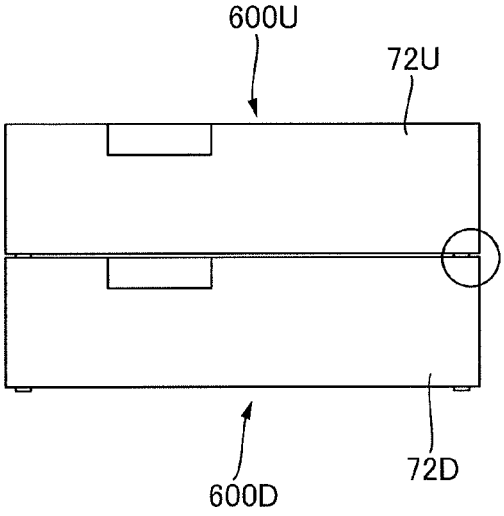
FIG. 13A is a front view illustrating upper and lower storage units.
Figure 13B:
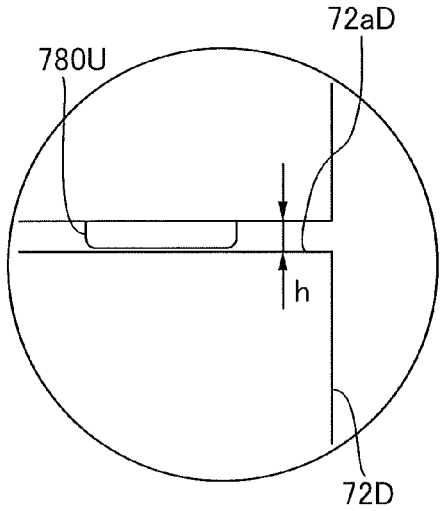
FIG. 13B is an enlarged front view illustrating a gap between the upper and lower storage units.
Figure 14A:
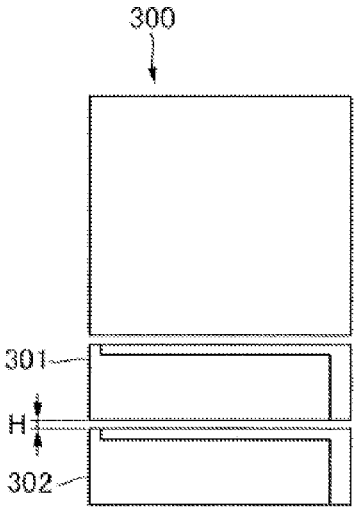
PRIOR ART FIG.14A
FIG. 14A is a side view illustrating a conventional image forming apparatus in which sheet feed cassettes are attached.
Figure 14B:
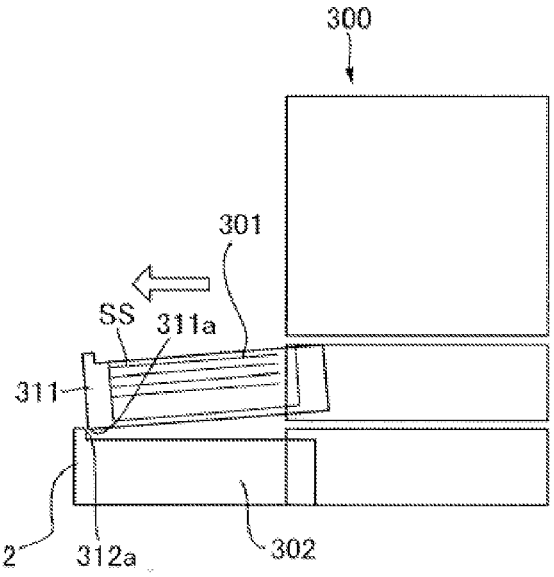
FIG. 14B is a side view illustrating a condition in which the sheet feed cassettes are drawn out of the image forming apparatus shown in FIG. 14A.

Still further, as shown in FIG. 12, two guide portions 800U and 800U (first and second guide portions) are provided at upper parts (upper surface) of the upper storage unit 600U. These guide portions 800U and 800U are also provided to be distant from each other in the direction orthogonal to the drawing direction at the both end portions of the exterior cover 72U. The rollers 780U and 780U and the guide portions 800U and 800U are disposed at positions corresponding vertically with each other.

The arrangement of the present embodiment makes it possible to obtain the following advantageous effect in addition to the effect of improving the manipulability of the storage unit described in the first embodiment. That is, according to the present embodiment, the rollers 780U and 780U of the upper storage unit 600U abut against the upper surface 72*a*D of the exterior cover 72D of the lower storage unit 600D in a state in which the upper storage unit 600U and 600D are attached to the main body as shown in FIG. 13. This arrangement makes it possible to assure a gap between the exterior cover 72U and 72D to be a constant gap h and to improve the appearance even if components and assembly of the frame vary.

It is noted that the storage unit may be provided with two or more rollers and guide portions, and the present invention is not limited to positions where these rollers and guide portions are provided. Still further, it is possible to arrange such that no guide portion is provided and only the roller is provided on the upper storage unit 600U, and no roller is provided and only the guide portion is provided on the lower storage unit 600D.

It is noted that the exterior covers 72U and 72D (first and second exterior covers) may be molded integrally with the storage portion 71U and 71D (second and first storage portions), respectively.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-246304, filed Dec. 4, 2014, which is hereby incorporated by reference herein in its entirety.

What is claimed is:

1. A sheet stacking apparatus, comprising:

a main body;

a first storage unit configured to be drawn out of/inserted into the main body and storing a sheet, the first storage unit comprising a guide portion; and a second storage unit configured to be drawn out of/inserted into the main body, provided above the first storage unit, and storing a sheet, the second storage unit comprising an abutment portion guided by the guide portion of the first storage unit when the second storage unit is being drawn out of the main body in a state in which the first storage unit has already been precedingly drawn out of the main body, wherein the second storage unit comprises a second storage portion storing the sheet and a second exterior cover provided at an end portion of the second storage portion in a drawing direction of the second storage unit, wherein the abutment portion is provided so as to project downward from a lower surface of the second exterior cover of the second storage unit, and wherein the abutment portion is a rotator rotatably supported by the second exterior cover.

2. The sheet stacking apparatus according to claim 1, wherein the second storage unit hangs downward in the state in which the second storage unit is drawn out of the main body in a case when a weight of sheets stacked in the second storage unit is heavier than a predetermined weight.

3. The sheet stacking apparatus according to claim 1, wherein the first storage unit comprises a first storage portion storing the sheet and a first exterior cover provided at an end portion of the first storage portion in a drawing direction of the first storage unit, and wherein the guide portion comprises an inclined surface inclined upward in the drawing direction of the first storage unit and being continuous to an upper surface of the first exterior cover.

4. The sheet stacking apparatus according to claim 1, wherein the first storage unit comprises a positioning portion positioning the stored sheet and a manipulation portion disposed at a position shifted from the guide portion in a direction orthogonal to a drawing direction.

5. The sheet stacking apparatus according to claim 4, wherein the manipulation portion comprises a lock mechanism configured to lock a move of the positioning portion.

6. The sheet stacking apparatus according to claim 1, wherein the guide portion is provided at a center part of the first storage unit in a direction orthogonal to a drawing direction, and wherein the abutment portion is provided at a center part of the second storage unit in the direction orthogonal to the drawing direction.

7. The sheet stacking apparatus according to claim 1, wherein the guide portion comprises first and second guide portions provided to be distant in the direction orthogonal to a drawing direction, and wherein the abutment portion comprises first and second abutment portions provided to be distant in the direction orthogonal to the drawing direction.

8. An image forming apparatus, comprising:

a main body;

an image forming portion forming an image on a sheet conveyed thereto;

a first storage unit configured to be drawn out of/inserted into the main body and storing a sheet on which an image is to be formed by the image forming portion, the first storage unit comprising a guide portion; and a second storage unit configured to be drawn out of/inserted into the main body, provided above the first storage unit, and storing a sheet, the second storage unit comprising an abutment portion guided by the guide portion when the second storage unit is being drawn out of the main body in a state in which the first storage unit has already been precedingly drawn out of the main body, wherein the second storage unit comprises a second storage portion storing the sheet and a second exterior cover provided at an end portion of the second storage portion in a drawing direction of the second storage unit, wherein the abutment portion is provided so as to project downward from a lower surface of the second exterior cover of the second storage unit, and wherein the abutment portion is a rotator rotatably supported by the second exterior cover.

9. The image forming apparatus according to claim 8, wherein the second storage unit hangs downward in the state in which the second storage unit is drawn out of the main body in a case when weight of sheets stacked in the second storage unit is heavier than a predetermined weight.

10. The image forming apparatus according to claim 8, wherein the first storage unit comprises a first storage portion storing the sheet and a first exterior cover provided at an end portion of the first storage portion in a drawing direction of the first storage unit, and wherein the guide portion comprises an inclined surface inclined upward in the drawing direction of the first storage unit and being continuous to an upper surface of the first exterior cover.

11. The image forming apparatus according to claim 8, wherein the first storage unit comprises a positioning portion positioning the stored sheet and a manipulation portion disposed at a position shifted from the guide portion in a direction orthogonal to a drawing direction.

12. The image forming apparatus according to claim 11, wherein the manipulation portion comprises a lock mechanism configured to lock a move of the positioning portion.

13. The image forming apparatus according to claim 8, wherein the guide portion is provided at a center part of the first storage unit in a direction orthogonal to a drawing direction, and wherein the abutment portion is provided at a center part of the second storage unit in the direction orthogonal to the drawing direction.

14. The image forming apparatus according to claim 8, wherein the guide portion comprises first and second guide portions provided to be distant in the direction orthogonal to a drawing direction, and wherein the abutment portion comprises first and second abutment portions provided to be distant in the direction orthogonal to the drawing direction.

15. A sheet stacking apparatus, comprising:

a main body;

a first storage unit configured to be drawn out of and inserted into the main body and storing a sheet, the first storage unit comprising a guide portion; and a second storage unit configured to be drawn out of/inserted into the main body, provided above the first storage unit, and storing a sheet, the second storage unit comprising an abutment portion guided by the guide portion of the first storage unit when the second storage unit is being drawn out of the main body in a state in which the first storage unit has already been precedingly drawn out of the main body, wherein the first storage unit comprises a first storage portion storing the sheet, and a supporting portion configured to support the guide portion, and wherein the guide portion is supported by the supporting portion so as to be located at a position higher than an upper end portion of the first storage portion in a height direction intersecting with a drawing direction of the first storage unit and comprises an inclined surface inclined upward in the drawing direction.

16. The image forming apparatus according to claim 15, wherein the guide portion is disposed on a center part of the supporting portion in a width direction intersecting with the drawing direction of the first storage unit.

17. The image forming apparatus according to claim 15, wherein the second storage unit comprises a second storage portion storing the sheet and a second exterior cover provided at an end portion of the second storage portion in a drawing direction of the second storage unit, wherein the abutment portion is provided so as to project downward from a lower surface of the second exterior cover of the second storage unit, and wherein the abutment portion is a rotator rotatably supported by the second exterior cover.

* * * * *